US010816162B2

(12) United States Patent
Suzuki et al.

(10) Patent No.: US 10,816,162 B2
(45) Date of Patent: Oct. 27, 2020

(54) VEHICULAR HEADLIGHT WITH LIGHT DIFFUSING, HEAT MITIGATING EXTENSION MEMBER

(71) Applicant: Ichikoh Industries, Ltd., Isehara-shi, Kanagawa (JP)

(72) Inventors: Eiji Suzuki, Isehara (JP); Katsuhiko Inoue, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 16/477,929

(22) PCT Filed: Jan. 19, 2018

(86) PCT No.: PCT/JP2018/001637
§ 371 (c)(1),
(2) Date: Jul. 15, 2019

(87) PCT Pub. No.: WO2018/135637
PCT Pub. Date: Jul. 26, 2018

(65) Prior Publication Data

US 2019/0368682 A1 Dec. 5, 2019

(30) Foreign Application Priority Data

Jan. 19, 2017 (JP) ..... 2017-007687

(51) Int. Cl.
*F21S 45/40* (2018.01)
*F21S 41/30* (2018.01)
*F21S 41/25* (2018.01)

(52) U.S. Cl.
CPC ..... *F21S 45/40* (2018.01); *F21S 41/25* (2018.01); *F21S 41/30* (2018.01)

(58) Field of Classification Search
CPC ..... F21S 41/40; F21S 41/43; F21S 41/435; F21S 41/47; F21S 45/10; F21S 45/40
See application file for complete search history.

(56) References Cited

U.S. PATENT DOCUMENTS 5,647,659 A * 7/1997 Mori ..... B60Q 1/0683 362/524
9,958,128 B2 * 5/2018 Faoucher ..... B60R 13/005
(Continued)

FOREIGN PATENT DOCUMENTS

JP 2-67502 U 5/1990
JP 6-10562 Y2 3/1994
(Continued)

OTHER PUBLICATIONS

International Search Report dated Mar. 27, 2018 in PCT/JP2018/001637 filed Jan. 19, 2018.

*Primary Examiner* — Evan P Dzierzynski
*Assistant Examiner* — Keith G. Delahoussaye
(74) *Attorney, Agent, or Firm* — Oblon, McClelland, Maier & Neustadt, L.L.P.

(57) ABSTRACT

In order to provide a vehicular headlight in which a rise in temperature of an extension member due to sunlight can be suppressed, and for which the appearance can be improved, a vehicular headlight includes: a light source; a reflector that reflects light from the light source; a lens having an entry surface through which light reflected by the reflector enters, and an exit surface from which the light that has entered the entry surface exits into an irradiation region in front of the vehicle; an extension member disposed at least in front of and below the lens in a vehicle-mounted state, and including a colored portion and a light-transmitting member that is disposed covering the colored portion and is capable of transmitting light; and a light-scattering portion provided at
(Continued)

least in a portion of the light-transmitting member below the lens in the vehicle-mounted state.

5 Claims, 4 Drawing Sheets

(56) References Cited

U.S. PATENT DOCUMENTS

| | | | | |
|---|---|---|---|---|
| 2015/0043235 | A1 | 2/2015 | Albou et al. | |
| 2015/0103544 | A1 | 4/2015 | Sano et al. | |
| 2017/0241612 | A1 * | 8/2017 | Puente ..... | F21S 43/26 |

FOREIGN PATENT DOCUMENTS

| | | | |
|---|---|---|---|
| JP | 2014-149981 | A | 8/2014 |
| JP | 2014-154253 | A | 8/2014 |
| JP | 2015-76364 | A | 4/2015 |
| JP | 2016-85801 | A | 5/2016 |
| JP | 2017-79189 | A | 4/2017 |

* cited by examiner

VEHICULAR HEADLIGHT WITH LIGHT DIFFUSING, HEAT MITIGATING EXTENSION MEMBER

TECHNICAL FIELD

The present invention relates to a vehicular headlight.

BACKGROUND ART

A vehicular lamp including a light source, a reflector that reflects light from the light source, and a lens from which the light reflected by the reflector exits into an irradiation region in front of the vehicle is known (for example, see PTL 1). In such a vehicular lamp, for example, the placement of a colored extension member along the outer periphery of the lens is being investigated in order to improve the appearance and the like.

CITATION LIST

Patent Literature

PTL 1: Japanese Utility Model Registration Publication No. 06-10562

SUMMARY OF THE INVENTION

Problems to be Solved by the Invention

However, in the vehicular lamp described above, sunlight sometimes focuses on the lower front side of the lens due to internal reflection and the like in the lens, resulting in irradiation of the extension member. If the extension member is colored, for example, in black at the section where the light focuses, the heat of the focused light is absorbed and causes a rise in temperature.

The present invention has been made in view of the above, and the object thereof is to provide a vehicular headlight in which a rise in temperature of an extension member due to sunlight can be suppressed, and for which the appearance can be improved.

Means for Solving the Problem

A vehicular headlight according to the present invention includes: a light source; a reflector that reflects light from the light source; a lens having an entry surface through which the light reflected by the reflector enters, and an exit surface from which the light that has entered the entry surface exits into an irradiation region in front of the vehicle; and an extension member disposed at least in front of a lower end of the lens in a vehicle-mounted state, wherein the extension member includes a light-transmitting member that has a plate shape, that is provided with a first surface facing forward in the vehicle-mounted state and a second surface on an opposite side to the first surface, and that is capable of transmitting light from the first surface to the second surface, a colored portion disposed on the second surface of the light-transmitting member, and a light-scattering portion provided at least in a portion of the light-transmitting member below the lens in the vehicle-mounted state.

Furthermore, the light-scattering portion may be disposed on a surface of the light-transmitting member.

Moreover, the light-scattering portion may be disposed in the light-transmitting member on an inner side, in a horizontal direction, of the vehicle in the vehicle-mounted state.

In addition, the extension member may be disposed so as to surround an outer periphery of the lens.

Furthermore, the colored portion may be black.

Effect of the Invention

According to the present invention, it is possible to provide a vehicular headlight in which heat generation of an extension member due to sunlight can be suppressed, and for which the appearance can be improved.

MODE FOR CARRYING OUT THE INVENTION

Hereinafter, embodiments of a vehicular headlight according to the present invention will be described with reference to the drawings. The present invention is not limited by the embodiments. Furthermore, the components presented in the following embodiments include those that can be easily replaced by persons skilled in the art, or substantially equivalent components. In the following description, an up-and-down direction and a left-and-right direction are directions in a vehicle-mounted state, in which the vehicular headlight is mounted to a vehicle, and indicate directions when the traveling direction of the vehicle is viewed from a driver's seat. In the present embodiments, the up-and-down direction is parallel to the vertical direction, and the left-and-right direction is the horizontal direction.

First Embodiment

Figure 1:
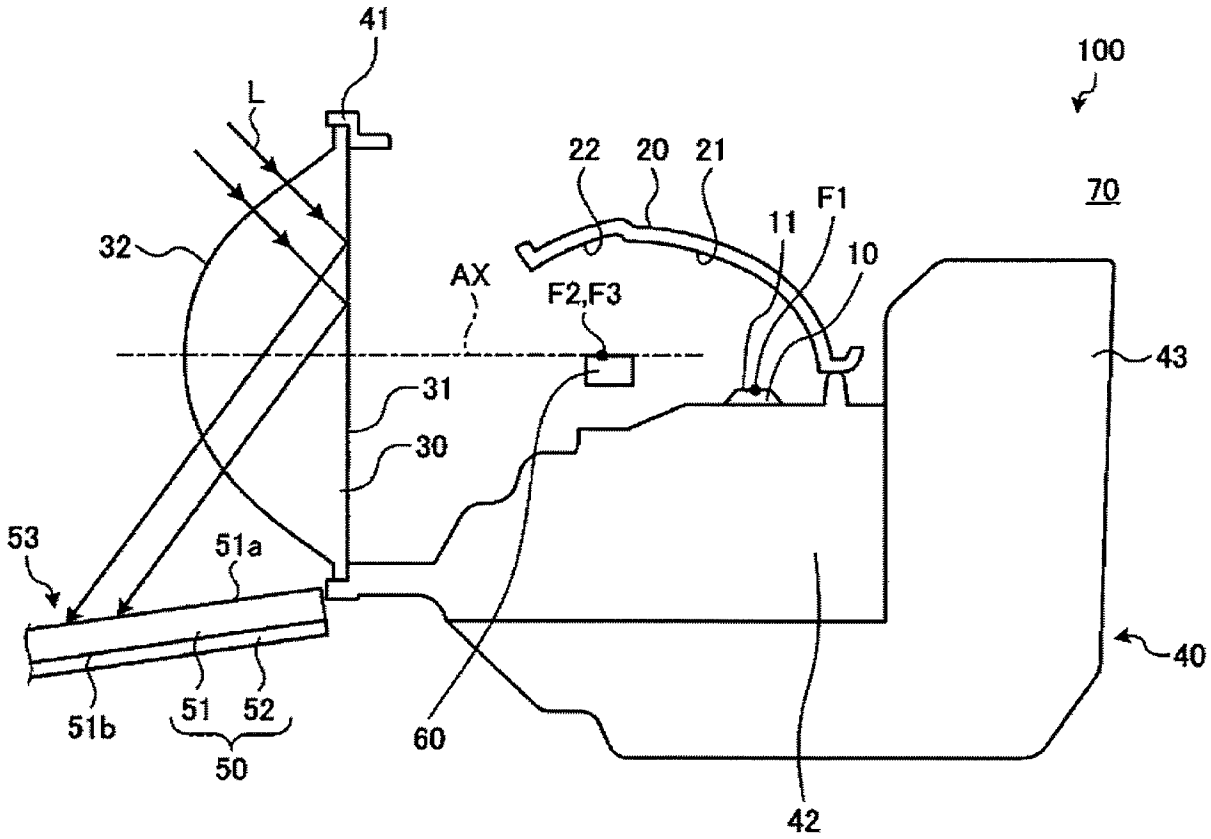
FIG. 1 is a cross-sectional view showing an example of a vehicular headlight according to a first embodiment.

FIG. 1 is a diagram showing an example of a vehicular headlight 100 according to a first embodiment. As shown in FIG. 1, the vehicular headlight 100 includes a light source 10, a reflector 20, a lens 30, an attachment member 40, and an extension member 50. The light source 10, the reflector 20, the lens 30, the attachment member 40, and the extension member 50 constitute a so-called projector-type lamp unit.

The vehicular headlight 100 is attached on each of the front left and front right sides of the vehicle. When attached to the vehicle, the vehicular headlight 100 is housed in a lamp chamber 70 formed by a lamp housing (not shown) and a lamp lens (for example, a transparent outer lens), and is connected to an optical axis adjustment mechanism (not shown). The optical axis adjustment mechanism enables the optical axis of the vehicular headlight 100 to be adjusted in the up-and-down direction and the left-and-right direction.

In addition to the lamp unit described above, for example, a clearance lamp unit, a turn signal lamp unit, a daytime running lamp unit, or the like, is sometimes disposed inside the lamp chamber 70. Furthermore, an inner panel (not shown), an inner housing (not shown), an inner lens (not shown), or the like, is sometimes disposed inside the lamp chamber 70.

In the present embodiment, the light source 10 is a semiconductor-type light source such as an LED, an OEL, or an OLED (organic EL). The light source 10 has a light-emitting surface 11. The light source 10 emits light such that the light-emitting surface 11 forms a Lambertian distribution. When the vehicular headlight 100 is attached to the vehicle, the light-emitting surface 11 is, for example, oriented upward and disposed parallel to a horizontal plane.

The light source 10 is fixed to a light source fixing portion 42 of an attachment member 40. The light source fixing portion 42 is joined to a heat sink 43. The heat sink 43 is provided with a fin (not shown). As a result, the heat generated in the light source 10, which is a semiconductor-type light source, is dissipated from the light source fixing portion 42 to the outside via the heat sink 43. The light source fixing portion 42 and the heat sink 43 may be integrally formed as a heat sink.

The reflector 20 reflects light from the light source 10 toward the lens 30. The reflector 20 is disposed above the light source 10, and is formed of, for example, a material that has a high heat resistance and is optically opaque, such as a resin member. The reflector 20 is fixed to the attachment member 40 by a fixing member such as a screw.

The reflector 20 has a hollow shape that has a front side section and a lower side section which are open, and a rear side section, an upper side section, and both left and right side sections which are closed. A first reflective surface 21 and a second reflective surface 22 are formed on an inner surface of the reflector 20. The first reflective surface 21 and the second reflective surface 22 reflect light from the light source 10 toward the lens 30.

The first reflective surface 21 and the second reflective surface 22 are spheroidal surfaces or free curved surfaces based on a spheroidal surface. The first reflective surface 21 and the second reflective surface 22 have a first focal point F1, a second focal point F2, and an optical axis (not shown) that joins the first focal point F1 and the second focal point F2. The first focal point F1 is disposed at the center of the light-emitting surface 11 of the light source 10, or in the vicinity thereof. The second focal point F2 is disposed in a position that overlaps with the focal point of the lens 30 described below.

Furthermore, a movable shade 60 is constituted by a member, such as a metal plate, which is capable of shielding the light from the light source 10. The movable shade 60 is disposed between the light source 10 and the lens 30. The movable shade 60 is connected to a drive unit (not shown), and is movable between a first position in which a portion of the light reflected, for example, by the reflector 20 is shielded, and a second position in which the light is not shielded.

The lens 30 is disposed closer to the front of the vehicle than the reflector 20. The lens 30 is, for example, supported by a lens holder 41. The lens 30 has a focal point (not shown) and an optical axis AX. The optical axis AX of the lens 30 coincides or substantially coincides with the optical axis of the reflector 20. The lens 30 irradiates reflected light from the reflective surface 21 toward the front of the vehicle.

The heat sink 43 dissipates the heat generated by the light source 10 to the outside. The heat sink 43 fixes the light source 10, the reflector 20, the lens holder 41 and the like described above. The heat sink 43 can be manufactured using, for example, a mold forming process.

The extension member 50 is disposed at least in front of and below the lens 30 in the vertical direction in the vehicle-mounted state. The extension member 50 includes a light-transmitting member 51, a colored portion 52, and a light-scattering portion 53.

The light-transmitting member 51 has a plate shape, and includes a first surface 51*a* that faces forward, and a second surface 51*b* on the opposite side to the first surface 51*a*. The distance between the first surface 51*a* and the second surface 51*b*, that is to say, a thickness T1 of the light-transmitting member 51 can be set, for example, to at least 1 mm but not more than 10 mm. The first surface 51*a* is a surface that is visible when, for example, an observer views the vehicular headlight 100 from the front. The light-transmitting member 51 is capable of transmitting light from the first surface 51*a* to the second surface 51*b*. The light-transmitting member 51 is formed using a resin material capable of transmitting light, such as plastic or acrylic. The light-transmitting member 51 may be formed using a material other than a resin material as long as the material is capable of transmitting light.

The colored portion 52 is provided on the second surface 51*b* of the light-transmitting member 51. The colored portion 52 may be a painted layer disposed on the second surface 51*b*, or may be a deposited layer. Furthermore, the colored portion 52 may be in a state where the second surface 51*b* is molded in multiple colors. Moreover, a separate member formed using a resin material such as plastic may be disposed as the colored portion 52. In addition, the colored portion 52 may also be a film or the like which can be attached to the second surface 51*b*. The colored portion 52 is, for example, colored in black, but is not limited to this. The colored portion 52 may be colored in a color other than black.

A light-scattering portion 53 is provided in the light-transmitting member 51. The light-scattering portion 53 is disposed in a position in the light-transmitting member 51 at which sunlight focuses as a result of internal reflection in the lens 30 in the vehicle-mounted state. For example, the light-scattering portion 53 is provided at least in a portion of the light-transmitting member 51 below the lens 30 in the vehicle-mounted state. The light-scattering portion 53 is provided, for example, on the first surface 51*a* of the light-transmitting member 51.

Figure 3:
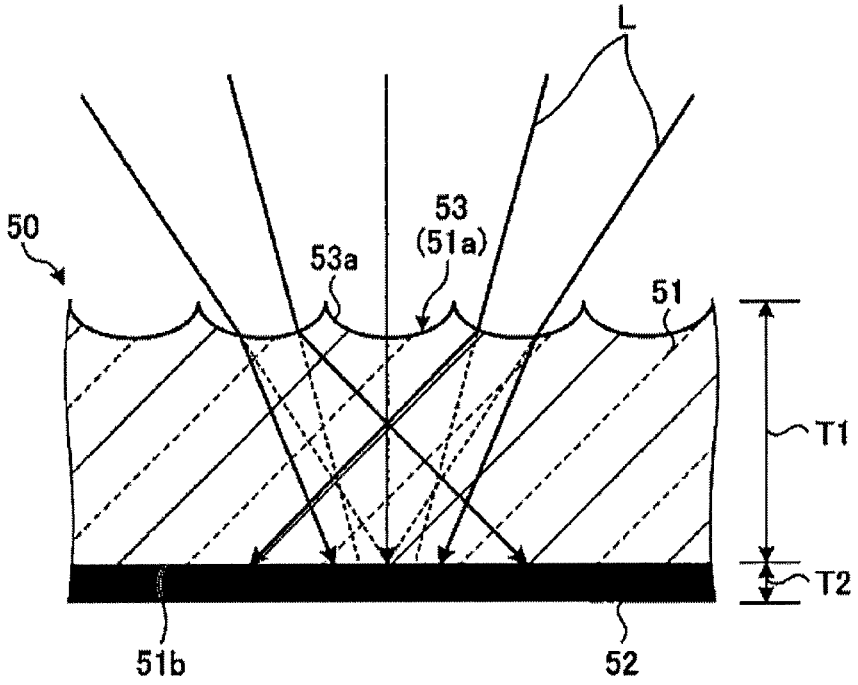
FIG. 3 is a cross-sectional view showing an example of a light-transmitting member and a light-scattering portion.

FIG. 3 is a cross-sectional view showing an example of the light-transmitting member 51 and the light-scattering portion 53. As shown in FIG. 3, the light-scattering portion 53 has a plurality of curved portions 53*a*. The plurality of curved portions 53*a* forms, for example, a shape in which the curved portions 53*a* are repetitively arranged on the surface of the light-transmitting member 51. The curved portion 53*a* may have the same shape and dimension as the other curved portions 53*a*, or at least one of the shape and the dimension of the curved portion 53*a* may be different from that of the other curved portions 53*a*. In the light-scattering portion 53, the light that enters by being focused from above is scattered by the curved portions 53*a* and exits downward.

In the vehicular headlight 100 configured as described above, the light source 10 is in a non-illuminated state if, for example, an illumination switch provided in the vehicle is off. If the illumination switch is switched on from this state, the light source 10 is illuminated. When the light source 10 is illuminated, light is radiated from the light-emitting surface 11, and is reflected toward the lens 30 side by the first reflective surface 21 and the second reflective surface 22 of the reflector 20. The light reflected by the reflector 20 enters the entry surface 31, passes through the inside of the lens 30, and exits from the exit surface 32.

Figure 2:
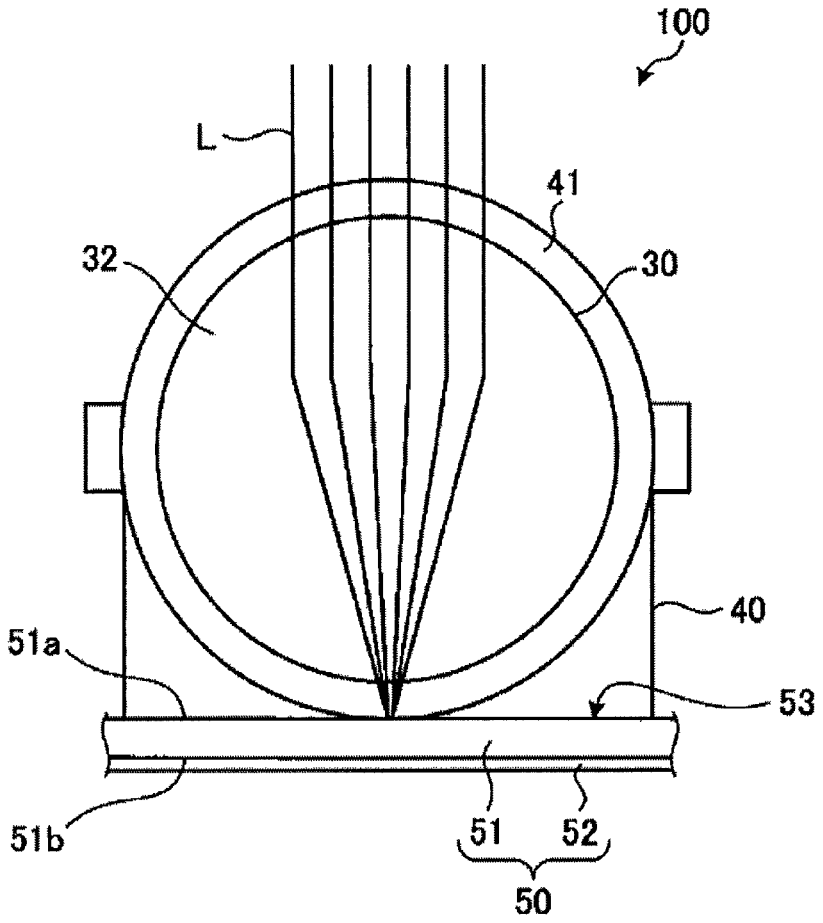
FIG. 2 is a front view showing an example of the vehicular headlight.

Furthermore, sunlight L sometimes enters the vehicular headlight 100. As shown in FIG. 1 and FIG. 2, for example, the sunlight L enters the lens 30 from the exit surface 32, is internally reflected by the entry surface 31, and then exits forward and downward from the exit surface 32. The sunlight L that exits from the exit surface 32 exits from the exit surface 32 in a focused state. In this case, the sunlight L that exits from the exit surface 32 is irradiated onto the extension member 50 in a focused state.

In the present embodiment, as shown in FIG. 3, the curved portions 53*a* that constitute the light-scattering portion 53 causes the sunlight L focused toward the extension member 50 to scatter and exit toward the colored portion 52 side. Consequently, the sunlight L that exits from the lens 30 in a focused state reaches the surface of the colored portion 52 in a scattered state. Therefore, compared to a case where the sunlight L is irradiated in a focused state, absorption of the heat of the focused light by the colored portion 52 can be reduced.

As described above, the vehicular headlight 100 according to the present embodiment includes: a light source 10; a reflector 20 that reflects light from the light source 10; a lens 30 having an entry surface 31 through which the light reflected by the reflector 20 enters, and an exit surface 32 from which the light that has entered the entry surface 31 exits into an irradiation region in front of the vehicle; an extension member 50 disposed at least in front of and below the lens 30 in a vehicle-mounted state, and including a colored portion 52 and a light-transmitting member 51 that is disposed covering the colored portion 52 and is capable of transmitting light; and a light-scattering portion 53 provided at least in a portion of the light-transmitting member 51 below the lens 30 in the vehicle-mounted state.

In the vehicular headlight 100, because the colored portion 52 is disposed on the second surface 51*b* of the light-transmitting member 51, the colored portion 52 is visible via the light-transmitting member 51 when an observer views the vehicular headlight 100 from the front. In this case, it is possible to give the observer the impression that the gloss of the light-transmitting member 51 is formed on the surface of the colored portion 52. As a result, the appearance can be improved. Furthermore, in the vehicular headlight 100, because the light-transmitting member 51 has the light-scattering portion 53, the light can be scattered in the light-scattering portion 53 toward the colored portion 52 side when the sunlight L focuses on the lower front side of the lens 30 due to internal reflection and the like in the lens 30. Therefore, absorption of the heat of the focused light by the colored portion 52 can be reduced. As a result, it is possible to provide the vehicular headlight 100 in which a rise in temperature of the extension member 50 due to the sunlight L can be suppressed, and for which the appearance can be improved.

Furthermore, in the vehicular headlight 100 according to the present embodiment, because the light-scattering portion 53 is disposed on the first surface 51*a* of the light-transmitting member 51, the sunlight L entering the light-transmitting member 51 from the first surface 51*a* can be efficiently scattered.

Furthermore, in the vehicular headlight 100 according to the present embodiment, the colored portion 52 is black. In this manner, even if the colored portion 52 has a black color that readily absorbs the sunlight L, the light directed toward the colored portion 52 side is scattered by the light-scattering portion 53, whereby absorption of the heat of the focused light is reduced.

Second Embodiment

Figure 4:
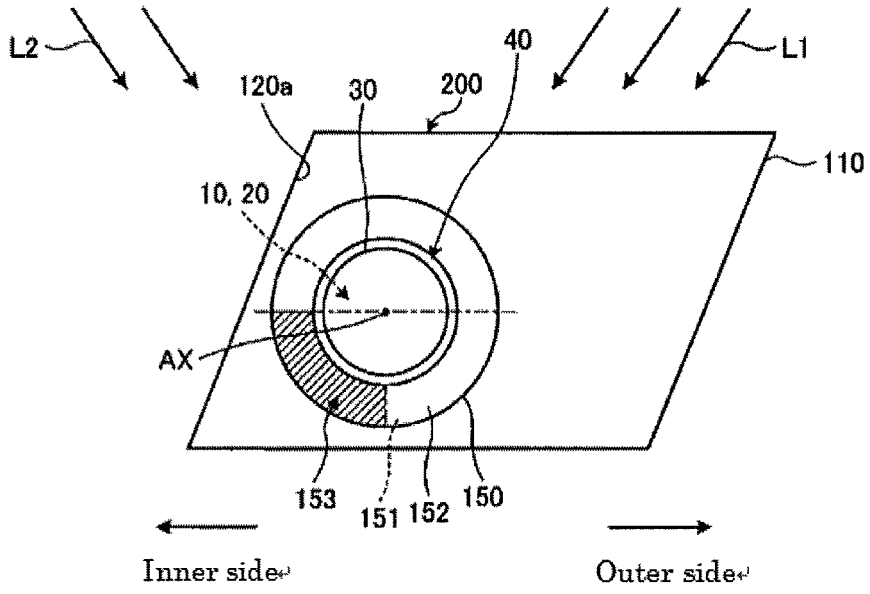
FIG. 4 is a front view showing an example of a vehicular headlight according to a second embodiment.
Figure 5:
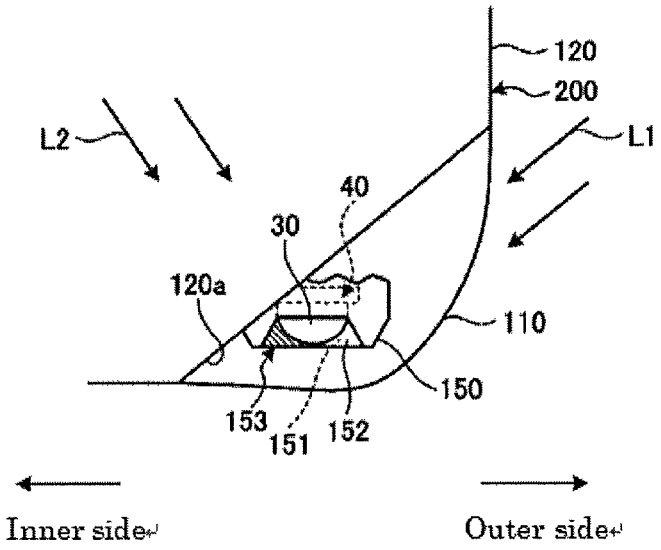
FIG. 5 is a plan view showing the vehicular headlight in a vehicle-mounted state.

FIG. 4 is a front view showing an example of a vehicular headlight 200 according to a second embodiment. FIG. 5 is a plan view showing an example of the vehicular headlight 200. In FIG. 5, a portion (upper portion) of an extension member 150 is omitted. In the vehicular headlight 200, the configuration of the extension member 150 is different from that of the first embodiment, and the other configurations are the same as that of the first embodiment. In the following description, the configuration of the extension member 150 that differs from that of the first embodiment will be mainly described.

As shown in FIG. 4, the extension member 150 is annularly disposed so as to surround an outer periphery of the lens 30 when viewed from the front of the vehicle. The extension member 150 includes a colored portion 151 and a light-transmitting member 152. The detailed configuration of the colored portion 151 and the light-transmitting member 152 can be the same configuration as that of the first embodiment.

The light-scattering portion 153 is disposed in the light-transmitting member 152 below the lens 30 and on the inner side of vehicle in the vehicle-mounted state. For example, the light-scattering portion 153 is disposed in the light-transmitting member 152 below a plane which is parallel to a horizontal plane that includes the optical axis AX of the lens 30, and on the inner side of the vehicle in the vehicle-mounted state. That is to say, the light-scattering portion 153 is provided in a region of the light-transmitting member 152 in the lower half and in the half on the inner side of the vehicle in the vehicle-mounted state. The light-scattering portion 153 may be disposed in a region of the light-transmitting member 152 in the lower half and in the half on the outer side of the vehicle in the vehicle-mounted state.

As shown in FIG. 5, when viewed from above the vehicle, the vehicular headlight 200 has a configuration in which an attachment end portion 120*a* and a lamp lens 110 expand toward the rear from the inner side toward the outer side of the vehicle 120. Consequently, a sunlight component L1 of the sunlight L which enters the vehicular headlight 200 from the outer side of the vehicle toward the inner side more readily enters the lens 30 than a sunlight component L2 that enters the vehicular headlight 200 from the inner side of the vehicle toward the outer side. If the sunlight component L1 enters the lens 30, the light focuses and exits below the lens 30 and on the inner side of the vehicle in the vehicle-mounted state as a result of internal reflection and the like.

Therefore, in the manner of the present embodiment, by disposing the light-scattering portion 153 at the position in which the sunlight component L1 is focused due to internal reflection in the lens 30 in the vehicle-mounted state, it becomes possible for the sunlight component L1 to reach the colored portion 151 after being efficiently scattered. As a result, it is possible to provide a vehicular headlight 200 in which a rise in temperature of the extension member 150 due to sunlight L can be suppressed, and for which the appearance can be improved.

The technical scope of the present invention is not limited to the embodiments described above, and appropriate modifications can be made within a scope not departing from the spirit of the present invention. For example, in the embodiments above, an example of a configuration was described in which a plurality of curved portions 53*a* is formed as the light-scattering portion 53, however it is not limited to this. For example, the light-scattering portion 53 may have a shape in which a three-dimensional body such as a plurality of polyhedrons is repetitively arranged on the surface of the light-transmitting member 51, a shape in which a plurality of wrinkles is formed on the surface of the light-transmitting member 51, and the like. Furthermore, in the embodiments described above, an example was described in which the light-scattering portion 53 is disposed on the first surface 51*a* of the light-transmitting member 51, however it is not limited to this. For example, the light-scattering portion 53 may be disposed inside the light-transmitting member 51. Examples of such a configuration include a light-transmitting member formed having a milky-white interior, and a light-transmitting member having fine light-reflecting fragment, such as glitter, in the interior.

REFERENCE SIGNS LIST

L Sunlight
L1, L2 Sunlight component
AX Optical axis
10 Light source
11 Light-emitting surface
20 Reflector
21 Reflective surface
30 Lens
31 Entry surface
32 Exit surface
40 Attachment member
41 Lens holder
42 Light source fixing portion
43 Heat sink
50, 150 Extension member
51, 151 Light-transmitting member
51*a* First surface
51*b* Second surface
52, 152 Colored portion
53, 153 Light-scattering portion
53*a* Curved portion
70 Lamp chamber
100, 200 Vehicular headlight

The invention claimed is:

1. A vehicular headlight, including:

a light source;

a reflector that reflects light from the light source;

a lens having an entry surface through which the light reflected by the reflector enters, and an exit surface from which the light that has entered the entry surface exits into an irradiation region in front of the vehicle; and an extension member disposed at least in front of a lower end of the lens in a vehicle-mounted state, wherein the extension member includes:

a light-transmitting member that has a plate shape, that is provided with a first surface facing forward in the vehicle-mounted state and a second surface on an opposite side to the first surface, and that is capable of transmitting light from the first surface to the second surface, a colored portion disposed on the second surface of the light-transmitting member, and a light-scattering portion provided in a position in the light-transmitting member at which sunlight focuses as a result of internal reflection in the lens in the vehicle-mounted state.

2. The vehicular headlight according to claim 1, wherein the light-scattering portion is disposed on the first surface of the light-transmitting member.

3. The vehicular headlight according to claim 1, wherein the light-scattering portion is disposed in the light-transmitting member on an inner side, in a horizontal direction, of the vehicle in the vehicle-mounted state.

4. The vehicular headlight according to claim 1, wherein the extension member is disposed so as to surround an outer periphery of the lens.

5. The vehicular headlight according to claim 1, wherein the colored portion is black.

* * * * *